United States Patent [19]

Lattig

[11] Patent Number: 4,715,355

[45] Date of Patent: Dec. 29, 1987

[54] ARROW REST FOR ARCHERY BOW

[76] Inventor: Krail N. Lattig, 2236 S. Pasfield, Springfield, Ill. 62704

[21] Appl. No.: 844,368

[22] Filed: Mar. 26, 1986

[51] Int. Cl.[4] ..... F41D 10/00

[52] U.S. Cl. ..... 124/41 A

[58] Field of Search ..... 273/DIG. 6; 524/419; 124/41 A, 24 R

[56] References Cited

U.S. PATENT DOCUMENTS

| | | | |
|---|---|---|---|
| 3,769,956 | 11/1973 | Simo | 124/41 A |
| 3,793,287 | 2/1974 | Fitz et al. | 524/419 |
| 4,579,101 | 4/1986 | Bateman | 124/41 A |
| 4,592,332 | 6/1986 | Topping | 124/41 A |

OTHER PUBLICATIONS

"New Materials: Modified 6/6 Nylon Have High Impact", Plastic World Magazine, Sep. 1984, p. 100.

*Primary Examiner*—Richard C. Pinkham
*Assistant Examiner*—Benjamin Layno

[57] ABSTRACT

This invention is a highly damage-resistant arrow rest assembly used to hold the arrow of an archery bow in the correct position during the drawing, aiming, and launching sequences. Its construction includes a support arm which supports the arrow and a journal arm having a flat cam surface which articulates with a bow-mounting connecting plate in such a way as to allow both forward and rearward rotation of the support arm. This unlimited rotational ability of the support arm allows minimum deflection of arrow flight due to interference of the support arm with the arrow fletching and prevents breakage of the arrow rest assembly due to accidental rearward rotation of the support arm. Both the proper outward positioning of the support arm and the unlimited rotational ability of the support arm are due to a resilient bias applied to the flat cam surface of the journal arm of the arrow rest assembly.

45 Claims, 11 Drawing Figures

ARROW REST FOR ARCHERY BOW

BACKGROUND OF THE INVENTION

In an archery bow, lateral guidance or windage of an arrow to the target is provided by a pressure point on a vertical surface called the sight window or riser of the archery bow. Vertical guidance or elevation is also provided by a pressure point which is commonly called the arrow rest.

Since the archery bow is an ancient weapon, numerous devices have been evolved to function as an arrow rest. Of these, the simplest has been the incorporation of an approximately 90° notch on the bow of which the horizontal surface was known as a shelf or arrow shelf. The arrow shelf provided adequate guidance of the arrow, but allowed the fletching of the arrow to collide with both the horizontal self and the vertical surface of the bow known as the sight window or riser. This collision of the fletching causes a deflection of the flight of the arrow and a corresponding loss of accuracy of the bow. It also damages the arrow fletching, particularly after repeated shooting of the same arrow. Numerous arrow rests have been developed with move support of the arrow above the shelf and often even away from the vertical riser.

Several prior-art arrow rests have been devised and manufactured that support the arrow during drawing and aiming, but which rotate forward by both friction of the moving arrow and by collision with the fletching following the launching of the arrow. These effectively reduce the inherent deflection of arrow flight caused by other arrow rests. However, all of these forward pivoting arrow rests have inherently designed physical appendages which limit their rearward rotation, frequently including a lever engaging a spring. See, for example, U.S. Pat. No. 3,769,956. Consequently, they are inherently fragile and can easily be damaged or destroyed by an accidental force applied in a rearward direction.

Those who are skilled in the art recognize that bows are often used in a harsh outdoor environment where opportunities are prevalent to accidentally damage or destroy a pivoting-type arrow rest.

SUMMARY OF THE INVENTION

(A) Ojbects

One object of this invention is to provide an arrow rest which properly supports the arrow of an archery bow during shooting.

Another object is to provide an arrow rest which is highly damage resistant.

Another object is to provide an arrow rest which minimizes deflection of the arrow's flight by limiting interference with the flight path of the arrow's fletching.

Another object is to allow the arrow rest assembly to be placed in such a position on the bow that it protrudes less than the horizontal guidance pressure point of the bow and that lies between an angle formed by two adjacent fletching members.

Another object of the invention is to provide an arrow rest assembly which permits the protruding tip ends of the arrow fletching to have maximum clearance of the bow and arrow rest structures.

(B) Summary

This arrow rest accomplishes the above-mentioned objectives and others that prior-art arrow rests do not by the use of a bidirectionally rotatable generally L-shaped member. A journal arm articulates with a bow mounting member through the use of a journal and bearing-type structure. A support arm supports the arrow in proper position for launch. The bow mounting member attaches to the riser of an archery bow through the use of adhesives, mechanical fasteners, or other means. The journal arm allows the rectilinear arm to rotate in the direction of arrow flight upon friction of the forward-moving arrow or upon contact with the passing arrow's fletching. This yielding motion allows passage of the arrow with minimal deflection from the intended flight path and with minimal damage to the fletching.

In one embodiment, an arrangement of spring pressure acting upon a cam surface of the journal arm accomplishes outward biasing of the support arm from the sight window of the bow, allows the support arm to yield with passage of the arrow and its fletching, and returns the support arm to its proper prelaunch position. This spring and cam surface arrangement allows the proper outward biasing of the support arm without the use of a physical stop-type structure to limit the rearward rotation of the arm. Therefore, any accidental rearward force applied to the support arm will harmlessly rotate the support arm rearward with little or no damage to any of the arrow rest structure. If and when such an accident occurs, the support arm is simply repositioned manually.

These and other features of the present invention will become apparent from consideration of the following specification when taken in conjunction with the accompanying drawings.

DESCRIPTION OF THE PREFERRED EMBODIMENTS

Figure 6:
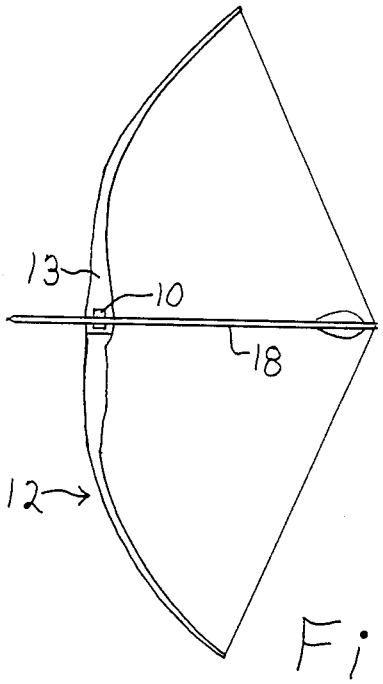
FIG. 6 is a side elevational view of a conventional bow with an arrow rest assembly of the present invention mounted thereon.

Referring now more particularly to the drawings and to those embodiments of the invention here chosen by way of illustration, FIG. 6 depicts the proper positioning of the arrow rest of present embodiment as represented by the arrow rest assembly 10 attached to the vertical riser 13 of a bow 12. The arrow 18 is shown in its proper position on the arrow rest assembly 10 immediately prior to the launch of the arrow.

Figure 1:
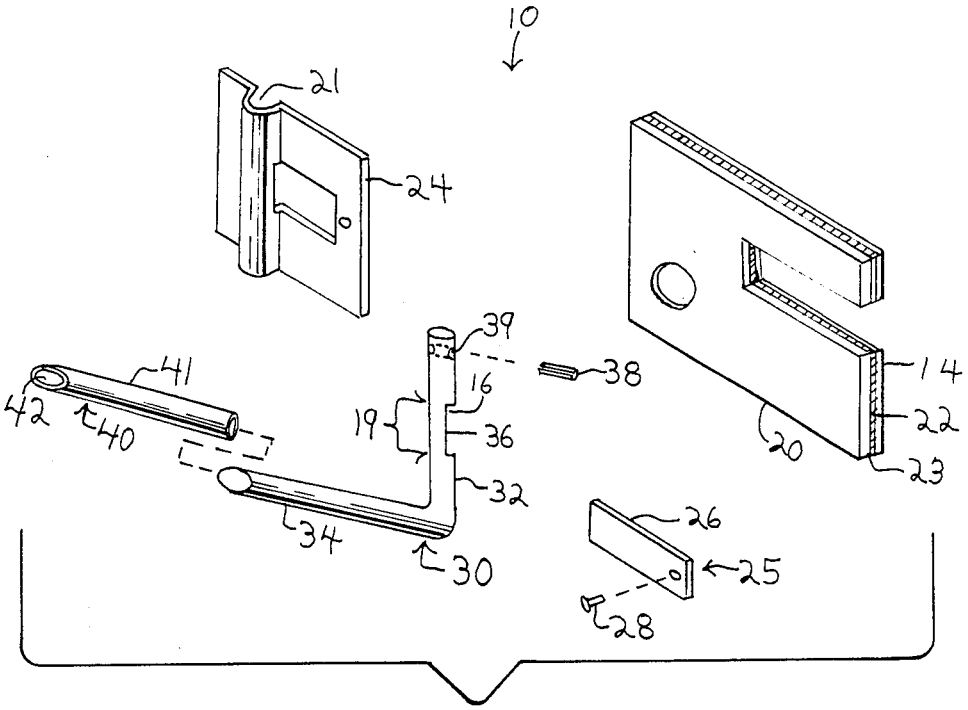
FIG. 1 is an exploded perspective view of an arrow rest assembly in accordance with the present invention.
Figure 2:
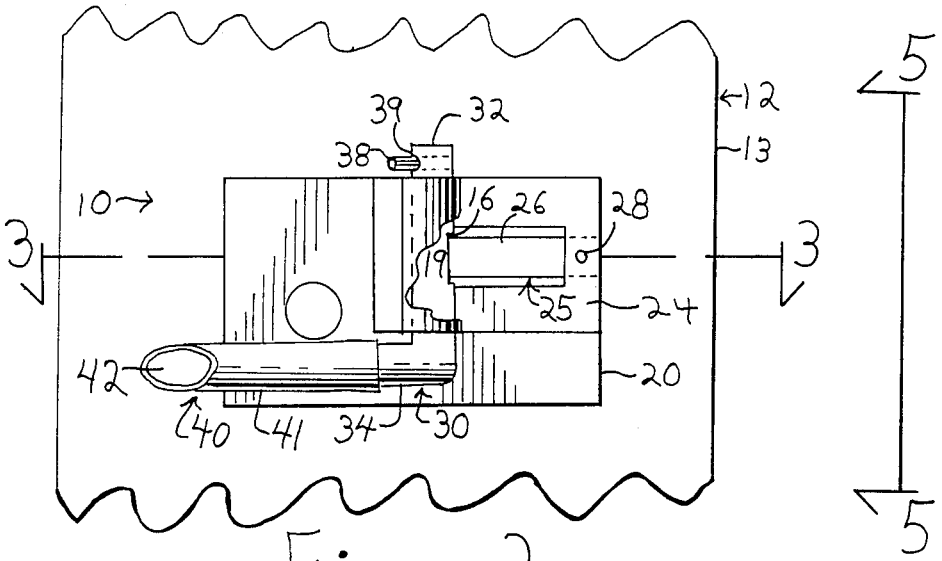
FIG. 2 is a side elevational view of the arrow rest assembly shown in FIG. 1 with the support arm in its arrow-receiving position and shown in conjunction with a fragmentary representation of a bow.
Figure 3:
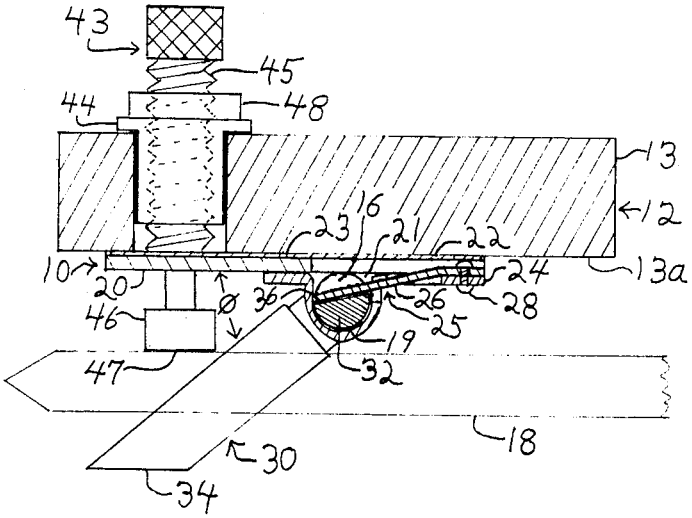
FIG. 3 is a cross-sectional view of the arrow rest taken substantially along the line 3—3 of FIG. 2, showing an arrow in phantom in position to be shot.

The device shown in FIGS. 1, 2 and 3 comprises an arrow rest assembly 10 including a substantially rectangular connecting plate 20. The connecting plate 20 will be discussed hereinafter. The rear surface 23 of plate 20 is connected to the bow 12 by a suitable pressure-sensitive adhesive 22. The adhesive 22 is covered by a paper 14 or the like which is to be removed just before mounting plate 20 on bow 12. Some of the most useful forms of the adhesive 22 are in combination with a foam, fabric or plastic tape substrate.

Attached to plate 20 by spot welding or other suitable means is a cover plate 24. Cover plate 24 contains a formed journal cavity 21. Journal cavity 21 receives a generally L-shaped arrow support means 30 including a journal arm 32. The arrow support means 30 is also comprised of a generally horizontal arrow support arm 34. Arrow support means 30 also includes a cam surface 19 and a slot 16, having a flat cam face 36. As shown in the embodiment of FIGS. 1 through 3, the arrow support means 30 is composed of a single bent metal rod.

When the cover plate 24 is attached to the connecting plate 20, it retains the journal arm 32 of support means 30 in the journal cavity 21, and thereby allows free rotation of the journal arm 32 in either a clockwise or counterclockwise direction. In general, this movement is limited only by the contact of the support arm 34 with the connecting plate 20.

The support arm 34 is biased outward from the bow by a resilient means 25 supplied in this embodiment by the spring 26, located in slot 16, and applied to the flat cam face 36 of the journal arm 32. The spring 26 is attached to cover plate 24 by the rivet 28. Because the tensioning spring 26 returns and holds the journal arm 32 of the arrow support means 30 in a consistently repeatable position within the journal cavity 21, the dimensional tolerances between the diameter of the journal arm 32 and the journal cavity 21 can be quite liberal. This allows free rotation of the journal arm 32 without loss of any precision in the functioning of the arrow rest.

The spring 26 depicted in this embodiment is of the leaf type. Other resilient means such as torsion springs and coil springs are equally viable. The spring 26 is composed of steel; however, many other materials are equally suitable, such as resilient devices and/or springs made of solid plastic or of fiber-reinforced plastic.

The angle $\phi$ that the support arm 34 is biased outward is 20° to 60° and is not critical. When FIGS. 2 and 3 are considered, it can be seen that this angle is controlled by the angle which the plane of the flat cam face 36 has in relationship to the support arm 34 and by the angle which spring 26 interfaces with cam face 36 in slot 16.

One of the primary features of the arrow rest of present invention is its ability to function properly without a physical appendage of the arrow support means 30 to limit rearward rotation of the support arm 34. A forward force on the support arm 34 such as shooting the arrow 18 (FIG. 6) causes the cam surface 19 to deflect the spring 26 inward. After passage of the arrow 18, the spring 26 returns the support arm 34 to its proper outward biased position as discussed above. A rearward force on the support arm 34, such as an accidental blow, will likewise cause the dam 19 inconjunction with the cam face 36 to deflect the spring 26 inward. If this rearward movement of the support arm 34 is sufficient to cause the cam face 36 to form an approximately 90° angle or greater with the spring 26, then the spring 26 can no longer act upon the flat cam face 36 and the support arm 34 will remain in a rearward position. The support arm 34 must be returned to its proper outward biased position manually. However, neither the support arm 34 or any structure of the arrow support means 30 or the spring 26 will have sustained any damage and the arrow rest of present invention will continue to function properly.

Figure 5:
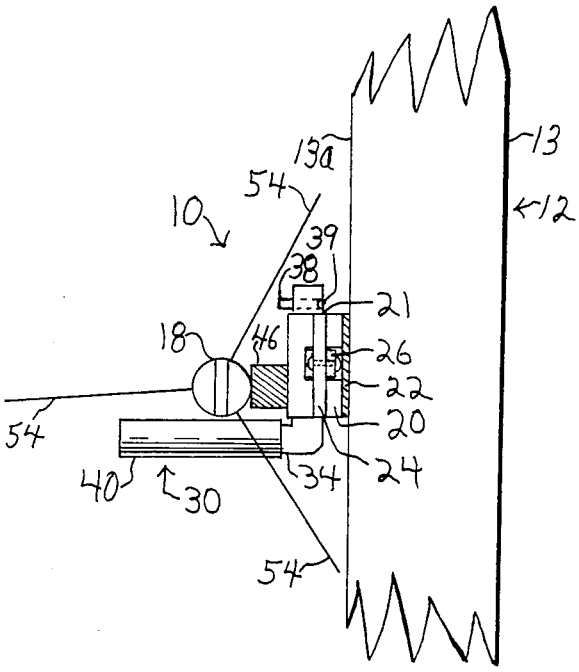
FIG. 5 is a vertical elevational view illustrating the arrow rest assembly attached to the riser of the bow and showing the shaft and fletching of an arrow in positioned to be shot and looking in the direction of the arrows along the line 5—5 in FIG. 2.

Looking further at FIGS. 1, 2 and 5, it is seen a retaining pin 38 is inserted in retaining pin hole 39 of the arrow support means 30 and projects out of the hole 39 over the top of the cover plate 24 sufficiently far enough to prevent the arrow support means 30 from falling from the journal cavity 21 during rearward movement of the support art 34. The retaining pin 38 is of the rolled tension pin type. Other types of retaining means are equally suitable, such as solid pins, taper pins, and numerous variations of external retaining rings and/or a crimp applied to the top of the journal arm.

The retaining pin hole 39 is located parallel to and in the same vertical plane as the support arm 34. Therefore, the retaining pin 38 does not limit the forward or rearward movement of the support arm 34.

The support arm 34 can be provided with a noise-reducing sleeve 40 to eliminate animal-scaring noises during the drawing and shooting of the arrow 18. This noise-reducing sleeve is hollow and includes a body portion 41 and a center opening 42. The sleeve 40 can be made of fabric or thread coverings or of various plastics such as fluorinated hydrocarbon plastic.

FIG. 3 depicts a common device widely used by archers to cushion the shock received by the arrow upon release of the bow string. This device is known as a cushion plunger 43. The threaded body 45 of the cushion plunger 43 is usually threaded into a bushing 44 and locked in place by the jam nut 48. The arrow 18 contacts the pressure point 47 of the cushion plunger piston 46 and is horizontally cushioned by a compression spring located inside the body 45.

FIGS. 3 and 5 depict the substantially corrected physical relationship between the arrow 18, the cushion-plunger piston 46, the arrow rest assembly 10 of present embodiment, and the riser 13 of the bow 12. From close examination it can be seen that the piston 46 holds the arrow 18 and its fletching 54 away from the side 13*a* of the bow 12 and the arrow rest assembly 10. Because the cushion movement of the piston 46 is short, usually less than 0.05 inches, this relationship is essentially maintained throughout the passage of the arrow 18 immediately following launch. The only normal contact that the fletching 54 of the arrow 18 has with the box 12 or the arrow rest assembly 10 is contact with the support arm 34. Because the support arm 34 freely moves forward upon contact with the fletching 54, the arrow 18 receives minimal deflection from its intended flight path.

FIGS. 1, 1A, 1B, 4, 4B, and 4C show successful variations of the arrow rest assembly of present invention. The connecting plate 20 of the embodiment represented by FIG. 1 is made from 0.050" stainless steel. The cover plate 24 is made from the same material and has the journal cavity 21 formed into shape by pressing. These dimensions and materials are use here as examples only. The invention of present embodiment is not limited to these dimensions or materials.

Materials used in the connecting plate 20, the cover plate 24 and the arrow support means 30 are not limited to the use of stainless steel. Many other materials are equally sufficient, such as brass alloys, steel, aluminum and injection moldable plastics such as molybdenum disulfide filed nylon 6/6.

In FIG. 1 the shape of the journal cavity 21 is formed into the cover plate 24 by pressing. The connecting plate 20 and the cover plate 24 are spot welded together and completely encircle the journal arm 32 when assembled.

Figure 1A:
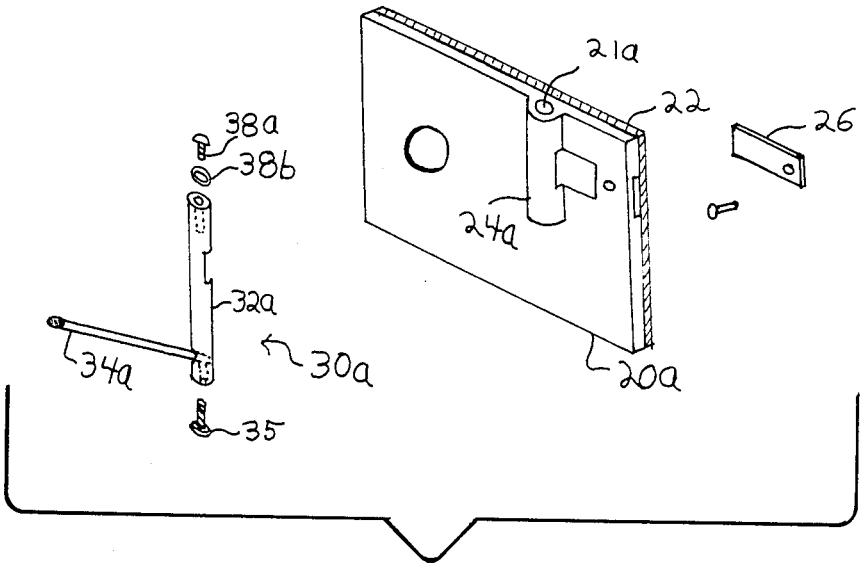
FIG. 1A is an exploded perspective view of one variation of an arrow rest assembly in accordance with the present invention.

In the variation of the invention represented in FIG. 1A, the connecting plate **20*a* is formed from molybdenum disulfide filed nyon 6/6. However, any other of a wide range of plastics are equally suitable. The connecting plate 20*a* has an integral journal body 24*a* which forms the journal cavity 21*a* and serves the same purpose as the cover plate 24 in FIG. 1**.

The arrow support means **30*a* depicted in FIG. 1A is a four-part steel assembly which includes the journal arm 32*a*, the support arm 34*a*, the support arm retaining screw 35 and the support assembly retaining screw 38*a* and washer 38B. The support arm 34*a* is easily replaceable and support arts of different flexibility can be easily substituted by simply loosening the retaining screw 35 and slipping the present support arm 34*a* from the journal arm 32*a* and replacing the support arm 34*a* with one of a different diameter or composition. The ability to vary the flexbility of support arm 34*a* allows the individual archer to give an exact vertical cushioning to the arrow in cases where it is necessary in order to finely tune a bow and arrow combination for ultimate accuracy. The replaceable support arm 34*a* allows the use of a horizontal arrow supporting structure of smallest mass which gives less resistance to the passage of an arrow and therefore less arrow deflection. This is desirable for use a on target bow where very fine accuracy is necessary and the bow is used in a much less harsh environment. In the event that the support arm 34*a*** should be broken during use, another support arm of similar type can quickly be substituted.

Figure 1B:
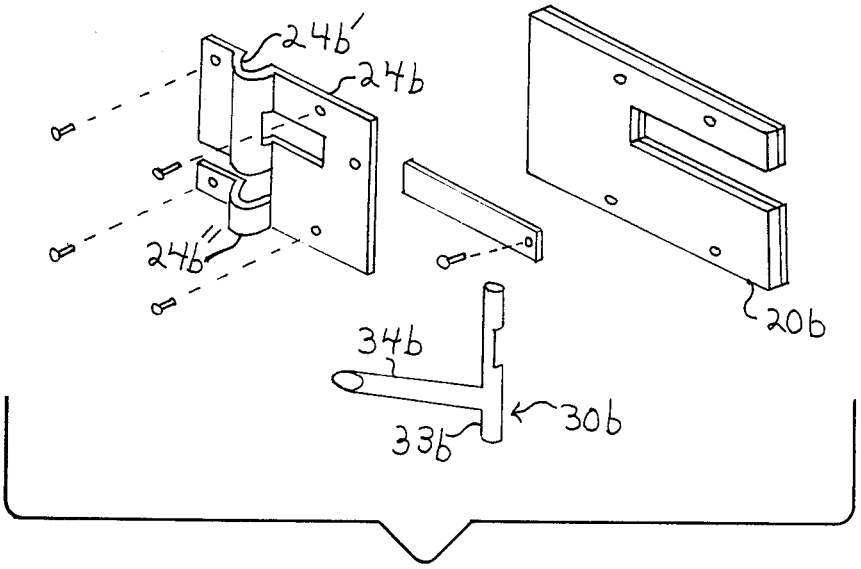
FIG. 1B is an exploded perspective view of another variation of an arrow rest assembly in accordance with the present invention.

FIG. 1B represents a variation of the present invention where the connecting plate **20*b* and the cover plate 24*b* are formed from aluminum or aluminum alloy. Cover plate 24*b* contains a formed two-part journaling body 24*b*' and 24*b*'' and is attached to connecting plate 20*b* through the use of rivets or other suitable means. The journaling body is formed as a two-part structure 24*b*' and 24*b*'' in order to journal the arrow support means 30*b* above and below the support arm 34*b*. The support means 30*b* is formed from molybdenum disulfide filed nylon 6/6 with an arm extension 33*b* which when interfaced in the above manner with the journaling body 24*b*' and 24*b*'' allows said support means 30*b* to be used without a retaining pin 38 as depicted in FIG. 1 or the retaining screw 38*a* and washer 38*b* as depicted in FIG. 1A**.

Figure 4:
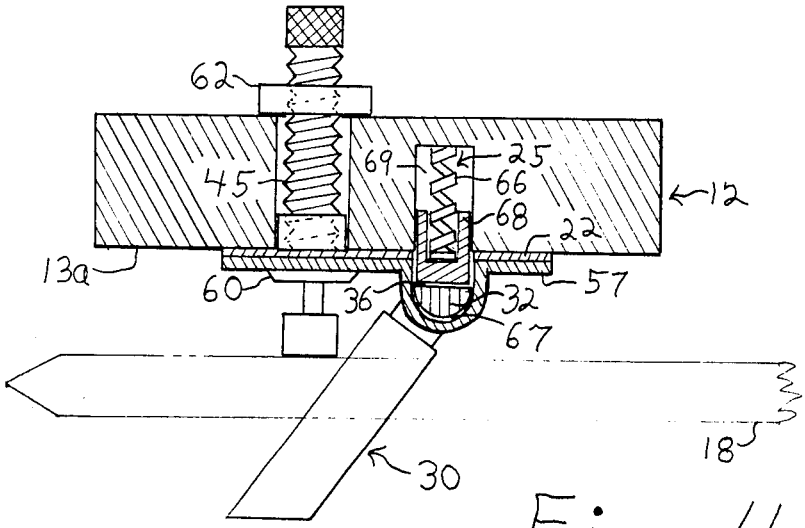
FIG. 4 is a cross-sectional view, similar to FIG. 3, of a variation of an arrow rest assembly.

A particularly successful embodiment of this invention is shown in FIG. 4 and is comprised of a connecting plate 57 which is formed of stainless steel and is attached to the bow 12 using an adhesive 22 and a nut 60 which is threaded onto the cushion plunger body 45 and drawn tight by the locking nut 62. The journaling cavity 67 is formed by a fold pressed into the connecting plate 57. The journaling cavity 67 is open on the side that mounts against the bow 12 and uses the side 13a of the bow to complete the encirclement of the journal arm 32.

In this embodiment, the outward biasing means 25 is applied to the flat cam face 36 of the journal arm 32 of the arrow support means 30 by a coil spring 66 and piston 68 which are contained in the cylinder 69 which is drilled into the bow 12. This embodiment pictured in FIG. 4 functions exactly the same as the embodiment depicted by FIGS. 1, 2 and 3. The only difference lies in the resilient means 25, which uses the compression of coil spring 66 instead of the deflection of the leaf spring 26 in FIGS. 1 and 2.

Figure 4B:
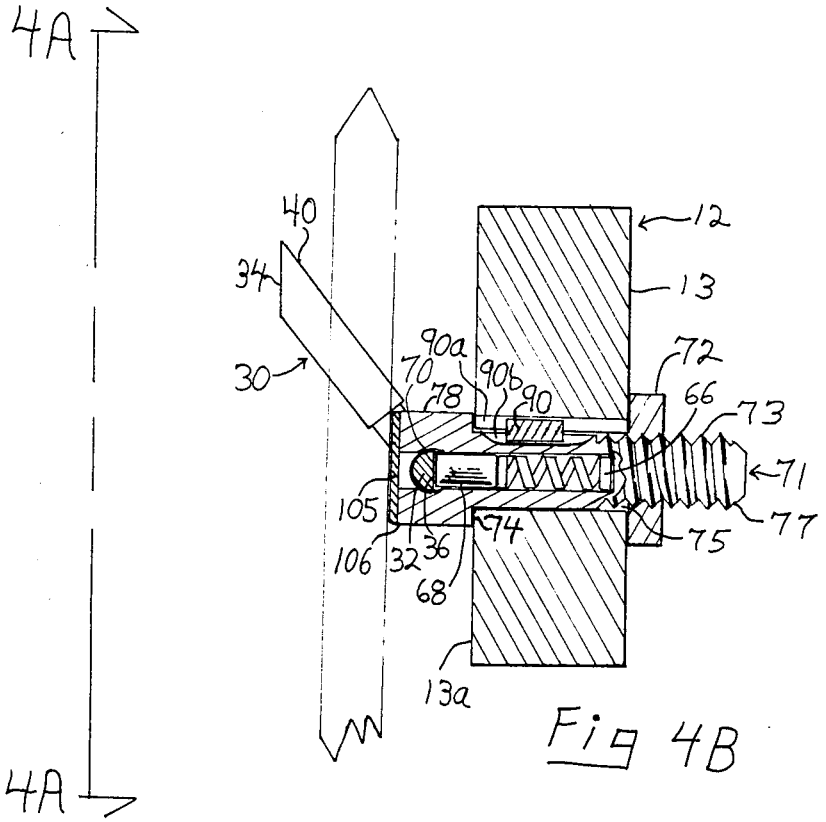
FIG. 4B is a cross-sectional view of the arrow rest in FIG. 4A taken substantially along the line 4B—4B in FIG. 4A.
Figure 4A:
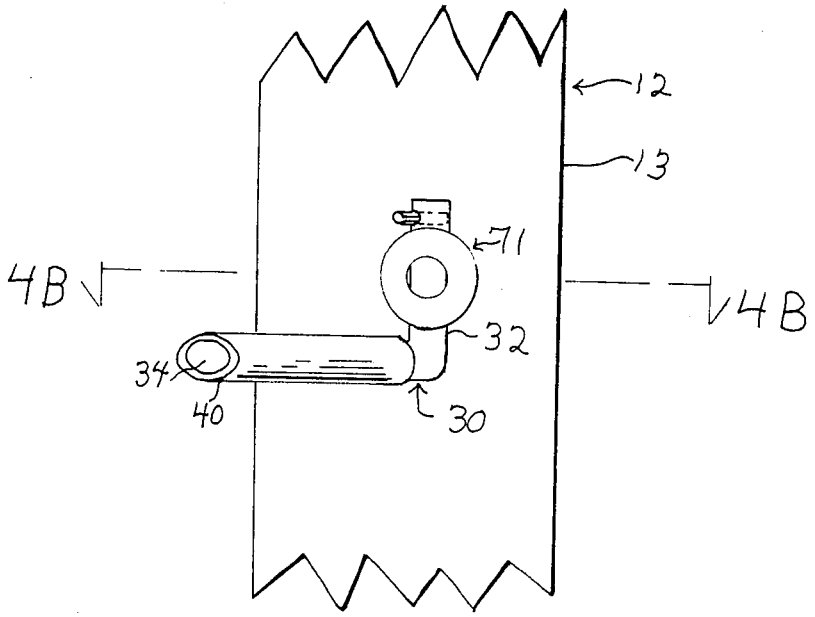
FIG. 4A is a side elevational view of a variation of the arrow rest shown mounted to the riser of the box and looking in the direction of the arrows along the line 4A—4A in FIG. 4B.

A variation similar to the one in CFIG. 4 is depicted in FIGS. 4A and 4B. This particular variation uses the same coil spring 66 and piston 68 for the outward bias of support means 30 by acting upon the flat cam face 36 of the journal arm 32. The major difference between this particular embodiment and that in FIG. 4 is that the journaling cavity 70 is a cylindrical opening that is contained within mounting means 71 which preferably comprises a cylindrical body 77 having a head 78 within which is located journaling cavity 70.

Cylindrical body 77 is mounted in opening 75 in the riser 13 of bow 12 and is retained in the riser 13 by a mounting nut 72 which is threaded onto the mounting threads 73 of mounting means 71. The mounting nut 72 draws the shoulder 74 of cylindrical body head 78 tightly into the side **13*a* of the vertical riser 13**.

Nonrotative means such as tapers, splines, keys, pins, washers, or geometric cross-sectional shafts can be used to prevent mounting means 71 from turning in opening 75. For example, a key 90 may be located in cooperating slots **90*a* and 90*b* respectively in the riser 13 and in the cylindrical body 77**.

A noise-reducing sleeve 40 covers arrow support arm 34. Also, a noise-reducing covering 105 is attached to the arrow contact end 106 of mounting means 71. This covering can be made of fabric, leather, hair and numerous kinds of plastics.

Figure 4C:
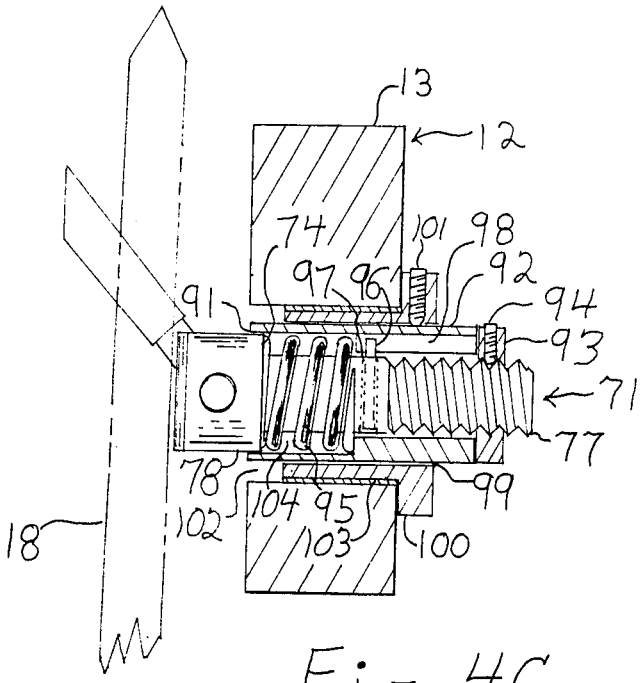
FIG. 4C is a cross-sectional view of a variation of the arrow rest shown mounted to the bow.

The materials from which these particular embodiments depicted in FIGS. 4A, 4B, and 4C can be made include, but are not limited to, those materials specified for other variations of this invention.

FIG. 4C is an embodiment of this invention which incorporates the functions and substantially the same components of the arrow rest depicted in FIGS. 4A and 4B and the functions of the cushion plunger 46 in FIG. 3 into one integrated unit. This is accomplished by extending mounting means 71 through cylindrical opening 91 of lateral position bushing 92. Cylindrical body 77 of mounting means 71 is retained in bushing 92 by retaining nut 93 which is locked onto mounting means 71 by set screw 94.

Cushioning of the arrow 18 is accomplished by cushioning spring 95 which is contained in spring cavity 104 and which applies outward pressure to should 74 of cylindrical body head 78 and allows the mounting means 71 to yield under the pressure of the initial shock of the release of arrow 18.

In this example, mounting means 71 is prevented from rotating by anti-rotation pin 96 which is fitted into pin opening 97 of mounting means 71 and which engages anti-rotation slot 98 of bushing 92. It is understood that any other means such as splines, keys, and geometric cross-sectioned shafts can be employed to limit rotation of mounting means 71. It is necessary, of course, that such means must not severely impede the in-and-out cushioning movement of mounting means 71.

Laterial positioning bushing 92 is mounted into opening 99 of bow mounting bushing 100 and is held in place by set screw 101. This arrangement allows the lateral positioning bushing to be located at a specifically desired position in or out of mounting bushing 100 and thereby allows arrow 18 to be positioned at a specifcally desired distance from riser 13 of bow 12.

Mounting bushing 100 is mounted in opening 102 which extends through riser 13 of bow 12. In this example bushing 100 is held in place by adhesive 103. It is understood, however, that any other fastening means such as an interference fit or engaging screw threads can be employed to attach mounting bushing 100 to riser 13.

Mounting bushing 100 is not a mandatory part of this particular embodiment. A successful model of lateral positioning bushing 92 has been made with external threads which directly engage threads cut into opening 102. This allows mounting bushing 100 to be eliminated and lateral positioning bushing 92 to be directly mounted into riser 13 of bow 12. Lateral positioning bushing 92 can then be locked into the specifically desired position in opening 102 by a simple jam nut or any other means.

It will, of course, be understood that the embodiments of the invention here presented are by way of illustration only and are meant to be in no way restrictive. Therefore, numerous changes and modifications may be made and the full use of equivalents resorted to without departing from the scope of the invention as defined by the appended claims.

I claim:

1. An archery arrow rest assembly for an archer bow comprising:
   a. a mounting means for attaching the arrow rest to a bow;
   b. a journaling body attached to or integral with said mounting means and forming a journaling cavity;
   c. an arrow support means rotatably mounted within said journaling cavity and including a journaling arm in said journaling body, and an arrow support arm extending outwardly from said journal arm;
   d. cam means, integral with said arrow support means, for locating said arrow support arm outwardly from said bow while allowing free back and forth rotation of said support arm, said cam means comprising a flat surface on a cylindrical body;
   e. resilient means for applying resilient bias to said cam means; and
   f. retaining means for preventing said arrow support means from escaping from said journal cavity.

2. An arrow rest assembly as claimed in 1 wherein said journaling body is a two-part structure.

3. An arrow rest assembly as claimed in 2 wherein said two-part structure is constructed such that the support arm of the arrow support means is positioned between said two-part journaling body structure.

4. An arrow rest assembly as claimed in claim 1, wherein said support arm is removable from said journal arm.

5. An arrow rest assembly according to claim 4 including means maintaining said support arm engaged with said journal arm.

6. An arrow rest assembly according to claim 5 wherein the means maintaining said support arm in place comprises a retaining screw.

7. An arrow rest assembly as claimed in 1 wherein said support arm is covered with a noise-reducing sleeve.

8. An arrow rest assembly as claimed in 1 wherein said retaining means comprises a retaining pin.

9. An arrow rest assembly as claimed in 1 wherein said retaining means comprises a retaining screw.

10. An arrow rest assembly according to claim 1 wherein said mounting means defines at least a portion of said journaling body.

11. An arrow rest assembly according to claim 10 wherein said journaling body defines said journal cavity.

12. An arrow rest assembly according to claim 1 wherein said journal arm and support arm are integral.

13. An arrow rest assembly according to claim 12 wherein said journal arm and said support arm are formed from the same piece of material.

14. An arrow rest assembly according to claim 1 wherein said journaling cavity is formed in two parts and wherein said journal arm and said support arm are integral and wherein an extending journal arm portion engages said journal cavity.

15. An arrow rest assembly according to claim 1 wherein said mounting means and said journal body are formed of metallic material and plastic material.

16. An arrow rest assembly according to claim 15 wherein metallic material is selected from steel, brass, aluminum and aluminum alloys.

17. The arrow rest assembly according to claim 1 wherein the mounting means comprises a spring loaded plunger.

18. The arrow rest assembly according to claim 1 wherein the mounting means comprises a spring cavity, a cylindrical body head, and a spring resiliently biasing the cylindrical body head outwardly from the spring cavity.

19. An archery arrow rest assembly for an archery bow comprising:
   a. a mounting means for attaching the arrow rest to a bow;
   b. a journal body attached or integral with said mounting means and forming a journal cavity;
   c. an arrow support means rotatably mounted within said journaling cavity and including a journal arm mounted within said journaling body and an arrow support arm extending outwardly from said journal arm;
   d. cam means, integral with said arrow support means, for locating said arrow support arm outwardly from said bow while allowing free back and forth rotation of said support arm, said cam means comprising a flat surface on a cylindrical body;
   e. resilient means for applying resilient bias to said cam means;
   f. retaining means for preventing said arrow support from escaping from said journal cavity; and
   g. means for locating an arrow upon said support arm a desired distance outwardly from said bow.

20. An arrow rest assembly according to claim 19 including means for cushioning shock received by the arrow upon release of the bow string.

21. An arrow assembly according to claim 20 wherein the means for locating said arrow comprises a piston and wherein said piston extends into a cylinder containing a compression spring to cushion the shock of releasing the bow string.

22. An arrow rest assembly according to claim 21 wherein said piston extends through an opening located within said mounting means.

23. An arrow rest assembly according to claim 22 wherein said cylinder is formed within an opening in said bow.

24. The arrow rest assembly according to claim 19 wherein the resilient means is adapted to be located within an opening provided in said bow and wherein the resilient means engages a cam member and wherein means are provided for maintaining said support arm movable back and forth relative to said bow.

25. An arrow support assembly according to claim 24 wherein said cam member engages a coil spring located within said bow.

26. An archery arrow rest assembly for an archery bow comprising:

a. a mounting means for attaching the arrow rest to a bow adapted to extend through a mounting opening in the bow;

b. a journal body attached or integral with said mounting means and forming a journal cavity;

c. an arrow support means rotatably mounted within said journal cavity and including a journal arm mounted in said journal cavity and an arrow support arm extending outwardly from said journal arm;

d. cam means, integral with said arrow support means, for locating said arrow support arm outwardly from said bow while allowing free back and forth rotation of said support arm, said cam means comprising a flat surface on a cylindrical body;

e. resilient means for applying resilient bias to said cam means;

f. retaining means for preventing said arrow support means from escaping from said journal cavity; and g. additional retaining means for preventing said mounting means for escaping from said mounting opening.

27. An arrow rest assembly according to claim 26 wherein said arrow support arm is covered with a noise-reducing sleeve.

28. An arrow rest assembly according to claim 26 wherein a noise-reducing covering is attached to said mounting means.

29. An arrow rest assembly according to claim 26 wherein the mountng means comprises a cylinder and a piston which extends into a said cylinder and engages a resilient spring which biases said cam means.

30. An arrow rest assembly according to claim 29 wherein said piston extends through an opening located within said cylinder.

31. An arrow rest assembly according to claim 30 wherein said additional retaining means comprises fastening means rotating said cylinder with said mounting opening.

32. An arrow rest assembly according to claim 31 wherein said fastening means comprises a threaded end of said cylinder and a threaded retaining nut.

33. An arrow rest assembly according to claim 29 including means for preventing said cylinder from rotating within said bow.

34. An arrow rest assembly according to claim 33 wherein said means for preventing rotating comprises a key.

35. An archery arrow rest asembly for an archery bow comprising:

a. a mounting means for attaching the arrow rest to a bushing extending through a mounting opening in said bushing;

b. a journal body attached to or integral with said mounting means and forming a journal cavity;

c. an arrow support means rotatably mounted within said journal cavity and including a journal arm mounted in said journaling body and an arrow support arm extending outwardly from said journal arm;

d. cam means, integral with said arrow support means for locating said arrow support arm outwardly from said bow while allowing free back and forth rotation of said support arm, said cam means comprising a flat surface on a cylindrical body;

e. a first resilient means for applying resilient bias to said cam means;

f. retaining means for preventing said arrow support means from escaping from said journal cavity;

g. a bushing for receiving said mounting means;

h. a second resilient means located in said bushing for applying resilient support to said mounting means;

i. an additional retaining means for preventing said mounting means from escaping said mounting opening; and j. a means for preventing said mounting means for rotating in said bushing.

36. An arrow rest assembly as claimed in 35 wherein said bushing attached directly to the bow through a mounting opening in the bow.

37. An arrow rest assembly as claimed in claim 35 wherein said bushing extends through and attaches to an additional bushing which is mounted to the bow through a mounting opening in the bow.

38. An arrow rest assembly as claimed in 35 wherein said means for preventing rotation of said mounting means is a pin engaging a slot.

39. An arrow rest assembly as claimed in 35 wherein said means for preventing rotation of said mounting means is a spline engaging a slot.

40. An arrow rest assembly as claimed in 35 wherein said arrow support arm is covered with a noise-reducing sleeve.

41. An arrow rest assembly as claimed in 35 wherein a noise-reducing covering is attached to said mounting means.

42. An arrow rest assembly for mounting to the side of a bow for supporting an arrow, the assembly comprising:

a base;

a generally L-shaped arrow support having a first leg journaled in the base about a vertical axis parallel to the longitudinal axis of the bow, and a second leg extending generally horizontally and pivotable in a generally horizontal plane;

a flat cam surface on the first leg of the arrow support;

means for engaging the flat cam surface on the first leg to resiliently bias the second arm generally laterally outwardly from the bow, said engaging means allowing the second arm to pivot forward and backward in a horizontal plane.

43. The arrow rest assembly according to claim 42 wherein said flat surface is oriented relative to the second arm so that the second arm extends generally forwardly, at an angle of between about 20° and about 60° with respect to the forward direction.

44. The arrow rest assembly according to claim 42 wherein the means for engaging the cam surface comprises a leaf spring.

45. The arrow rest assembly according to claim 42 wherein the base comprises a spring-loaded plunger.

* * * * *